US005094152A

United States Patent [19]

Müller

[11] Patent Number: 5,094,152

[45] Date of Patent: Mar. 10, 1992

[54] DEVICE FOR THE OUTLET OF SUPPLY AIR

[75] Inventor: Gottfried Müller, Kolbingen, Fed. Rep. of Germany

[73] Assignee: Schako Metallwarenfabrik Ferdinand Schad KG Zweigniederlassung Kolbingen, Kolbingen, Fed. Rep. of Germany

[21] Appl. No.: 506,267

[22] Filed: Apr. 9, 1990

[30] Foreign Application Priority Data

Apr. 12, 1989 [DE] Fed. Rep. of Germany ... 8904583[U]

[51] Int. Cl.[5] ..... F24F 13/06

[52] U.S. Cl. ..... 454/296; 454/308; 454/906

[58] Field of Search ..... 98/40.01, DIG. 10, 40.05, 98/40.1, 40.12, 40.13, 40.14

[56] References Cited

U.S. PATENT DOCUMENTS

| | | | |
|---|---|---|---|
| 988,496 | 4/1911 | Obermann | 98/118 |
| 2,807,329 | 9/1957 | Caldwell | 98/40.01 |
| 2,820,406 | 1/1958 | Argentieri | 98/40.01 |
| 4,620,869 | 11/1986 | Goossens et al. | 98/40.1 |

FOREIGN PATENT DOCUMENTS

| | | | |
|---|---|---|---|
| 0533063 | 9/1931 | Fed. Rep. of Germany | 98/40.12 |
| 0132894 | 9/1951 | Sweden | 98/40.12 |
| 0885733 | 11/1981 | U.S.S.R. | 98/40.01 |

*Primary Examiner*—Albert J. Makay
*Assistant Examiner*—William C. Doerrler
*Attorney, Agent, or Firm*—Bachman & LaPointe

[57] ABSTRACT

A ventilation device comprises a hollow body having an air inlet end and an air outlet end, swirl disk associated with the air outlet end and a perforated disk associated with the air inlet end.

8 Claims, 2 Drawing Sheets

DEVICE FOR THE OUTLET OF SUPPLY AIR

BACKGROUND OF THE INVENTION

The present invention relates to a ventilation device, in particular for the outlet of supply air into a space, having a basic body on which at one end a swirl disk is fixed and on the other end is connected via a nozzle to an air-supply duct.

Such a device is known, for example, as a ceiling swirl outlet. In this device supply air, which has been brought via appropriate supply systems, hits the inside of a swirl disk which is pierced with swirl outlets. These swirl outlets may, for example, be arranged annularly and be manufactured by punching. Wall parts between two punched parts are angled relative to the plane of the swirl disk so that the air leaving also has a corresponding swirl.

The air supply into a space is significantly improved as a result.

These known ceiling swirl outlets are however, relatively loud and have certain disadvantages with respect to the distribution of the supply air to the swirl disk before it leaves.

Accordingly, the inventor set himself the object of improving a device of the abovementioned type such that supply air is brought into the space more quietly and wherein the distribution of the supply air is also improved.

SUMMARY OF THE INVENTION

The foregoing object is achieved by associating a perforated disk with the nozzle of the ventilation device.

The perforated disk is preferably pierced with fine-jet perforations, as a result of which, according to the result of laboratory tests conducted by the inventor, it is possible to achieve a significantly more exact rise in pressure so that there is an even distribution in the stages inside the device. It has been shown to be the case that associating the fine-jet perforated disk with the swirl disk inside the nozzle ensures a draft-free and problem-free supply of air in ventilation technology.

The perforated disk is preferably intended to cover the clear width of the nozzle. In this connection, it is within the scope of the invention that the perforated disk can be both seated on the nozzle and inserted into the nozzle. The arrangement of an inwardly directed annular collar on the nozzle, which the perforated disk can then abut from inside the basic body or from outside, however, ensures a better retention of the perforated disk.

The perforated disk is fastened to this annular collar by, for example, spot-welding, rivets or similar types of fastening or fastening elements known in the art.

The arrangement of the perforated disk also enables the swirl disk to be retained more easily. In this respect, it is sufficient for a screw, the threaded shaft of which reaches through the perforated disk, to pierce the swirl disk approximately in the center thereof. In a further exemplary embodiment of the invention, the separate fixing of the perforated disk on the annular collar could also, for example, be omitted, by the perforated disk abutting the annular collar from the outside and the screw acting in the manner of a tension screw between perforated disk and swirl disk. In order to center the perforated disk, a raised edge in the transition region between annular collar and nozzle is then, for example, sufficient. In this case, the annular collar needs t be recessed in the nozzle by only a small amount.

This stepped outlet according to the invention can be manufactured in a wide variety of diameters according to requirements or the quantity of air required. It is simple to produce, but offers enormous functional advantages as compared to known ceiling swirl outlets.

BRIEF DESCRIPTION OF THE DRAWINGS

Further advantages, features and details of the invention emerge from the following description of a preferred exemplary embodiment, and with reference to the drawing, wherein FIG. 1—Is a plan view of a stepped outlet of the ventilation device according to the invention.

DETAILED DESCRIPTION

Figure 1:
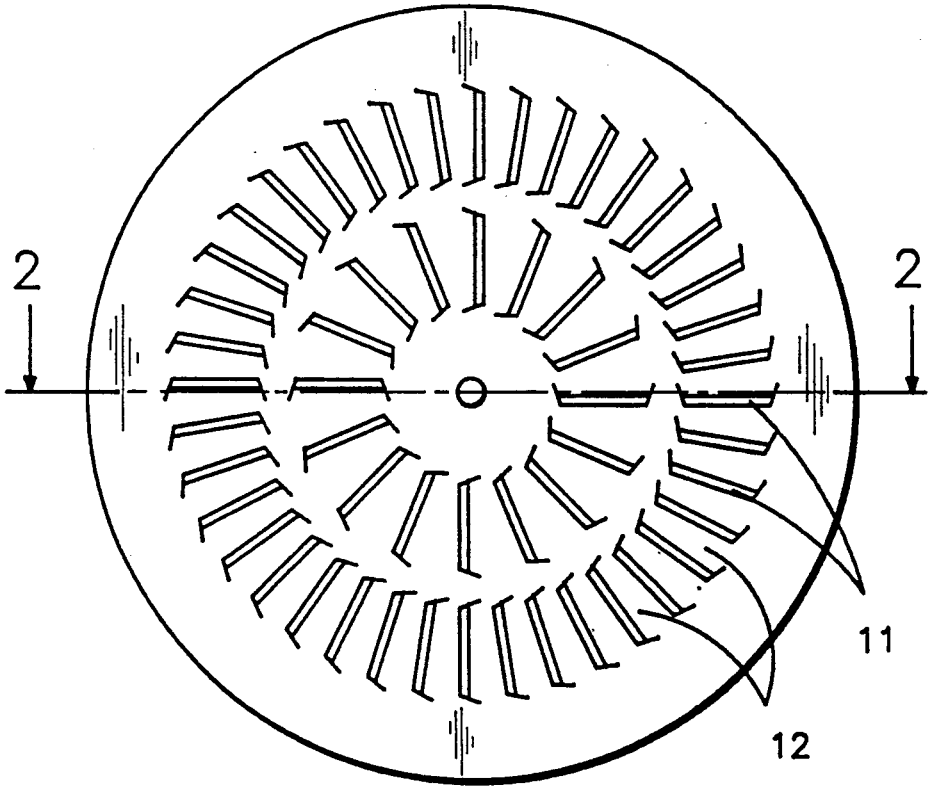
Figure 2:
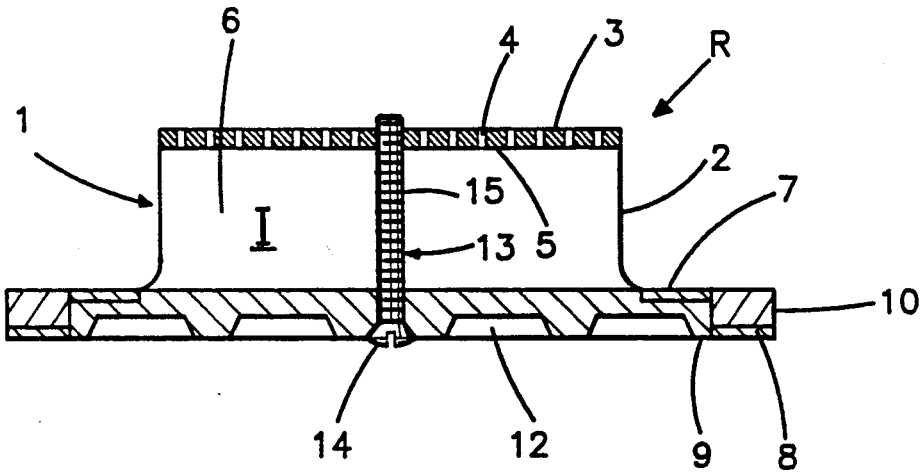
FIG. 2—Is a cross-section through the stepped outlet according to FIG. 1 along line II—II.
Figure 2A:
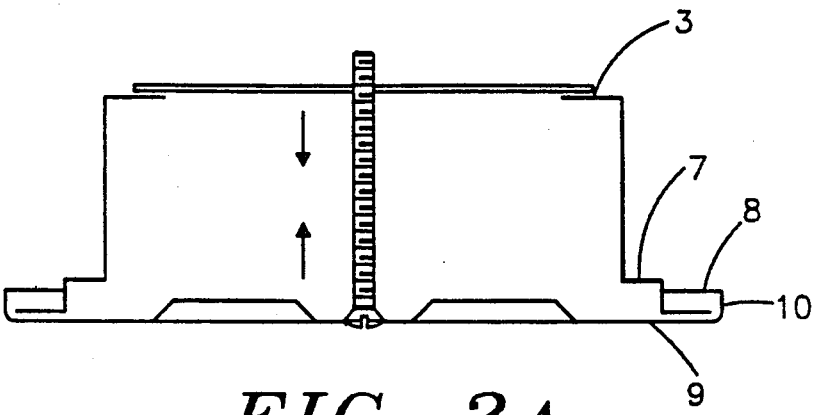
FIGS. 2*a* and 2*b*—are side elevation views of FIG. 2 showing that the perforated disk can be above or below the annular collar.
Figure 2B:
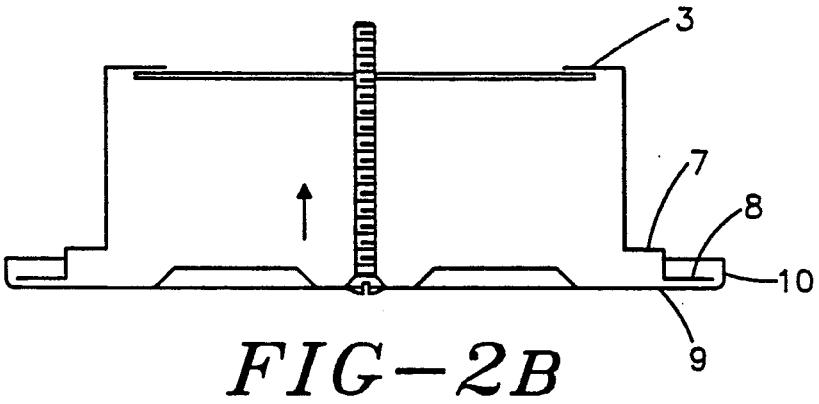
Figure 3:
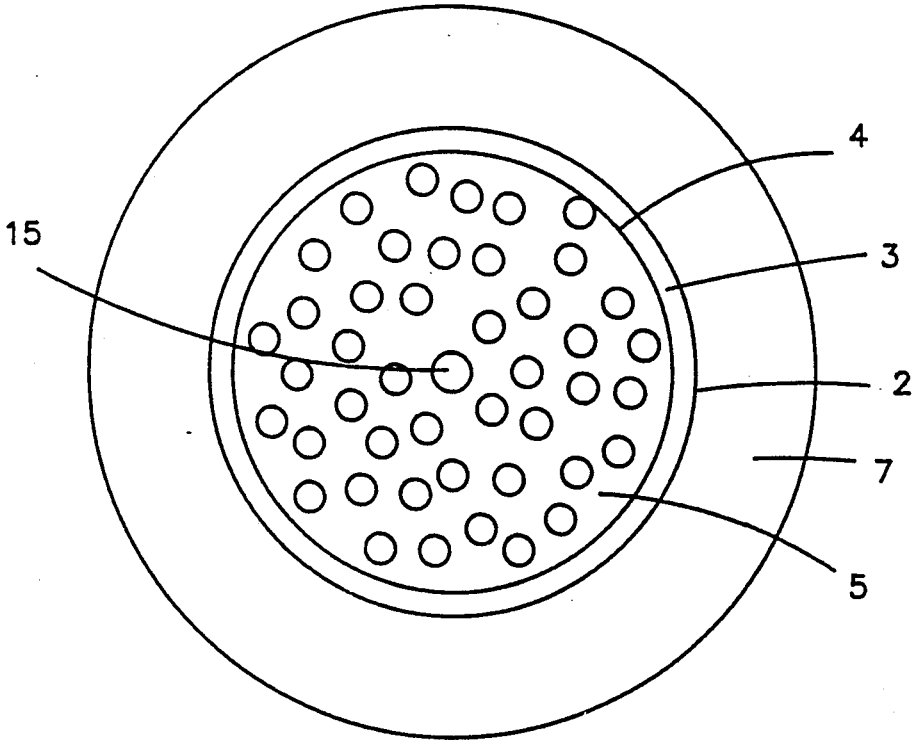
FIG. 3—Is a plan view of the inlet of the ventilation device according to the invention.

According to the Figures, a ventilation device R according to the invention has a basic hollow body designed with a stepped shape. This basic body 1 has a nozzle portion 2 which, at one end, is connected to an inwardly directed annular collar 3. This annular collar 3 defines an inlet opening 4 for supply air which is to be communicated into an open space. According to the invention, the inlet opening 4 is covered by a perforated disk 5 which has a plurality of fine-jet perforations.

A stepped shoulder 7, which merges into a bearing ring 8 which is integrally formed with the nozzle portion 2 at its other end. A swirl disk 9 is positioned within and abuts this bearing ring 8. The swirl disk 9 is thus surrounded by the bearing ring 8 with side wall 10.

The swirl disk 9 has annularly arranged outlet slots 11 as can be seen clearly from FIG. 1. These outlet slots 11 are produced by stamping such that wall parts 12 are formed between two outlet slots and are turned inwards and angled at least partially towards the inside I of the basic hollow body 1.

While the perforated disk 5 is preferably joined securely to the annular collar 3 by spot-welding, spot-soldering or with appropriate rivets, the swirl disk 9 is fixed to the basic body 1 by a screw 13 which abuts the outside of the swirl disk 9 with a screw head 14 and partially pierces the perforated disk 5 with a threaded shaft 15.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A ventilation device adopted to be secured to the outlet of an air-supply duct for supplying air under pressure from the duct to an open space comprising a hollow body having an air inlet end and an air outlet end and defining a substantially constant air flow passage from said inlet end to said outlet end, swirl disk means having a circular array of outlet slots homogeneously distributed thereon associated with said air outlet end of said hollow body for feeding air to said open space in a homogeneous manner, and perforated disk means associated with said air inlet end of said hollow body for receiving air from said air-supply duct such that air is supplied to said open space in a quiet manner.

2. A ventilation device according to claim 1 wherein said perforated disk means is provided with a plurality of fine apertures over substantially the entire surface thereof.

3. A ventilation device according to claim 1 wherein the perforated disk means is located within the hollow body.

4. A ventilation device according to claim 3 wherein the hollow body is provided with an inwardly directed annular collar on the air inlet end thereof and the perforated disk means abuts said annular collar.

5. A ventilation device according to claim 4 wherein the perforated disk means is fixed to the annular collar.

6. A ventilation device according to claim 1 wherein the swirl disk mean is joined to the perforated disk means via a screw.

7. A ventilation device according to claim 1 wherein the hollow body is provided with an inwardly directed annular collar on the air inlet end thereof and the perforated disk means abuts said annular collar.

8. A ventilation device according to claim 1 wherein said swirl disk means further includes a second circular array of outlet slots homogeneously distributed thereon wherein one of said array of outlet slots is disposed within the other array of outlet slots.

* * * * *